US005340705A

United States Patent [19]

De Keyzer et al.

[11] Patent Number: 5,340,705

[45] Date of Patent: Aug. 23, 1994

[54] PROCESSING LIQUID FOR USE IN SILVER COMPLEX DIFFUSION TRANSFER PROCESSING

[75] Inventors: René De Keyzer, Sint-Niklaas; Raymond L. Odeurs, Edegem; Luc A. De Brabandere, Lier, all of Belgium

[73] Assignee: AGFA-Gevaert, N.V., Mortsel, Belgium

[21] Appl. No.: 26,209

[22] Filed: Mar. 2, 1993

Related U.S. Application Data

[63] Continuation of Ser. No. 917,681, Jul. 22, 1992, abandoned, which is a continuation of Ser. No. 711,604, Jun. 7, 1991, abandoned, which is a continuation-in-part of Ser. No. 524,463, May 17, 1990, abandoned.

[30] Foreign Application Priority Data

May 18, 1989 [EP] European Pat. Off. ..... 89201253.5

[51] Int. Cl.[5] ..... G03C 5/54; G03C 5/30; G03C 5/38

[52] U.S. Cl. ..... 430/456; 430/249; 430/251; 430/455; 430/487; 430/489; 430/490; 430/492

[58] Field of Search ..... 430/233, 248, 249, 251, 430/449, 455, 456, 486, 487, 489, 490, 492

[56] References Cited

U.S. PATENT DOCUMENTS

| | | | |
|---|---|---|---|
| 1,925,557 | 9/1933 | Dundon | 430/486 |
| 2,017,167 | 10/1935 | Russell | 430/486 |
| 3,576,633 | 4/1971 | Henn et al. | 430/489 |
| 4,568,634 | 2/1986 | Hayashi et al. | 430/455 |
| 4,632,896 | 12/1986 | Tsubai et al. | 430/249 |
| 4,649,096 | 3/1987 | Tsubai et al. | 430/249 |
| 4,740,452 | 4/1988 | Okutsu et al. | 430/439 |

*Primary Examiner*—Richard L. Schilling
*Attorney, Agent, or Firm*—Breiner & Breiner

[57] ABSTRACT

An aqueous alkaline processing liquid for use in silver halide photography, wherein said liquid comprises one or more alkanolamines, the said alkanolamines consisting of one or more tertiary alkanolamines in a total amount in the range from 0.3 mol/l to 1.5 mol/l, and one or more secondary alkanolamines in an amount from 0 mol % to 30 mol % with respect to the amount of tertiary alkanolamine(s), and said liquid also contains sulphite ions in an amount in the range of 16 g/l to 30 g/l.

5 Claims, No Drawings

PROCESSING LIQUID FOR USE IN SILVER COMPLEX DIFFUSION TRANSFER PROCESSING

This is a continuation of copending application Ser. No. 07/917,681 filed on Jul. 22, 1992 now abandoned; which, in turn, is a continuation of application Ser. No. 07/711,604 filed on Jun. 7, 1991, now abandoned; is a continuation-in-part of application Ser. No. 07/524,463 filed May 17, 1990, now abandoned.

BACKGROUND OF THE INVENTION

The present invention relates to an aqueous alkaline processing liquid suitable for use in silver halide photography, more particularly for use in silver complex diffusion transfer reversal processing.

The constituents of a typical developer solution for the development of photo-exposed silver halide emulsion layer materials are a developing agent, alkali, preservative and restrainer acting as antifoggant. The concentrations and the types of constituent have a marked effect on the behaviour of the developer from which is expected, especially in the field of professional photography such as graphic art photography, that reproducible development results are obtained.

Problems encountered with regard to the obtaining of reproducible development results are for a great deal due to the contact of the developer solution with the atmosphere. From the atmosphere oxygen and carbon dioxide enter the developer solution whereby reducing power and alkalinity of the developer decrease.

It has therefore been a main concern to inhibit aerial oxidation and to decrease as much as possible the take up of carbon dioxide that lowers the alkalinity of the developer. In a particular case the aerial oxidation of the developing agent(s) is prevented by incorporating them in non-alkaline conditions in the photographic material itself and to rely in the processing on an alkaline processing liquid, called activator liquid, originally free from developing agent(s).

The aerial oxidation of the developing agent(s) is effectively counteracted by the presence of sulphite ions originating e.g. from sodium sulphite that acts also as alkalinity providing substance.

Suitable developing agents for the exposed silver halide are e.g. hydroquinone and 1-phenyl-pyrazolidine-3-on developing agents as well as p-monomethyl aminophenol .

The alkaline processing solution usually contains sufficient alkaline substances to bring the pH above 10, e.g. sodium hydroxide, sodium carbonate, borax, tertiary sodium phosphate. lithium hydroxide and amines, particularly alkanolamines.

It is not of common practice to use alkanolamines in processing solutions for the classical silver halide photography. In the silver complex diffusion transfer reversal process, called hereinafter DTR-process, said compounds have been introduced already commercially. Liquid processing formulations for use in the DTR-process containing amines and alkanolamines are described e.g. in U.S. Pat. Nos. 2,702,244, 4,568,634 and 4,632,896 and GB 2 159 968.

Tertiary alkanolamines having a pKa value higher than 8.5 and their use in the DTR-process are described in Research Disclosure, July 1987, item 27939 in which it is made clear that alkanolamines and more particularly tertiary alkanolamines as alkali providing substances have a fairly low $CO_2$-absorption.

In the processing of photographic silver halide emulsion materials preference is given to a processing liquid which provides a broad temperature latitude and high development rate. By temperature latitude is understood the temperature range wherein an almost high quality of image results is obtained. A particularly good temperature latitude means the production of almost the same image quality in a temperature range of 5 to 40° C. Further the processing liquid should show a broad development latitude by which is understood that the processing liquid withstands very well environmental influences, e.g. the influence of oxygen and carbon dioxide of the air and the influence of the contact with the photographic material to be developed. Development rate concerns the reaction rate wherein a certain silver image density is built up in the photo-exposed silver halide emulsion material in classical silver halide halide photography or in an image-receiving material applied in the silver complex diffusion transfer reversal process.

In practice not all requirements set forth for a developer can be fulfilled simultaneously and therefore it is desirable to have at one's disposal a processing liquid offering an optimized relationship between temperature latitude, development latitude and development rate. It has always been one of the objectives in classical silver halide photography and particularly in DTR-processing to shorten processing times. For the latter purpose it is particularly important that the processing liquid can penetrate rapidly into the hydrophilic colloid layer containing the developable silver halide grains and when applying DTR-processing likewise into the development nuclei containing image-receiving layer so that take-up of processing ingredients is as high as possible in order to have a very rapid and very intense deposit of silver thus forming an image with high optical density and steep gradation suited for halftone reproduction.

The DTR-process initially intended for office copying purposes has found now wide application in the graphic art field, particularly in the production of halftone (screened) prints from continuous tone originals.

The principles of the silver complex diffusion transfer reversal process, have been described e.g. in U.S. Pat. No. 2,352,014 and in the book "Photographic Silver Halide Diffusion Processes" by André Rott and Edith Weyde—The Focal Press—London and New York (1972).

In the DTR-process non-developed silver halide of an information-wise exposed photographic silver halide emulsion layer material is transformed with a so-called silver halide solvent into soluble silver complex compounds which are allowed to diffuse into an image-receiving element and are reduced therein with a developing agent, generally in the presence of physical development nuclei, to form a silver image having reversed image density values with respect to the silver image obtained in the exposed photographic material.

The silver halide solvent, mostly sodium thiosulphate, may be supplied from the non-light-sensitive image-receiving element as mentioned above, but it is normally at least partly already present in the alkaline processing solution.

It has been established experimentally (see e.g. the above mentioned Research Disclosure) that DTR-processing solutions containing alkanolamines and more particularly tertiary alkanolamines as alkalinity source offer the advantage of having a comparatively low carbon dioxide absorption and consequently provide a better pH stability and more equal reaction kinetics to the processing solution.

Unfortunately when using alkanolamines the speed of silver image formation is normally not as high as is obtained with inorganic alkali processing solutions containing inorganic alkali providing pH values above 13.

SUMMARY OF THE INVENTION

It is an object of the present invention to provide a processing liquid suitable for use in particular for the silver complex diffusion transfer reversal process, which liquid offers a good relationship between temperature latitude, development latitude and development rate, and which makes it possible to produce reproducibly optically dense silver images having steep gradation within relatively short processing times over a several day running (several day contact time with the atmosphere) of the processing liquid.

Another object of the present invention is to provide a method for carrying out the silver complex diffusion transfer reversal (DTR-) process wherein a processing liquid is used that offers reproducible silver image formation results over several day running of said processing liquid and by means of which optically dense DTR-silver images are obtained within fairly short processing times.

Other objects and advantages of this invention will become apparent from the description that follows.

According to the present invention an aqueous alkaline processing liquid for use in a silver complex diffusion transfer reversal (DTR-) process is provided, wherein said process is carried out by development of an information-wise exposed silver halide emulsion layer with a developing agent in the presence of a silver halide solvent to form diffusible silver complexes which diffuse into an image-receiving layer containing development nuclei, (1) wherein said liquid contains no inorganic alkaline substance(s) other than an alkali metal sulfite or alkali metal thiosulfate or contains said substance(s) in an amount lower than 0.05 mole/l, (2) wherein said liquid contains a thiosulfate compound in a concentration in the range of 0.03 to 0.13 mole/l, (3) wherein said liquid comprises one or more alkanolamines, the said alkanolamines consisting of one or more tertiary alkanolamines in a total concentration in the range of 0.3 mole/1 to 1.5 mole/l, and one or more secondary alkanolamines in an amount from 0 mole % to 30 mole % with respect to the amount of tertiary alkanolamine(s), and (4) said liquid also contains sulfite ions in a concentration of 16 g/1 to 30 g/l.

According to the present invention a silver complex diffusion transfer reversal (DTR-) process is provided in which an information-wise exposed photographic silver halide emulsion layer is moistened with an aqueous alkaline processing liquid as defined above, such moistening proceeding while or before said silver halide emulsion layer is in relationship with an image-receiving layer to allow therein the transfer of complexed silver ions.

DETAILED DESCRIPTION OF THE INVENTION

By using a processing liquid of which the alkali providing substances substantially consist of (a) tertiary alkanolamine(s) and which has a sulphite concentration as defined above the total anion content of the processing liquid is within ranges wherein fairly rapid swelling of the hydrophilic binder of the photographic material, and of the image-receiving layer, can take place whereby in very short times a fairly large amount of processing liquid ingredients is taken up resulting in high processing rate and short processing time. By the fact of a very low carbon dioxide absorption the processing liquid has a long running life time at a nearly constant concentration of chemicals. The concentration of chemicals is kept fairly good at the desired level and in balance by at the one side a concentration raise due to evaporation of water introduced in the atmosphere and at the other side by the consumption of chemicals taken up in the processed materials.

The sulphite ions act as a preservative protecting developing agent(s) against aerial oxidation and are rejuvenating hydroquinone type developing agents by reactions known in the art (ref. e.g. A Textbook of Photographic Chemistry—by D. H. O. John and G. T. J. Field—Chapman et Hall Ltd. London (1963) p.74–75). Sulphite has also a favourable pH stabilizing action (buffer action to neutralize acid liberated in the silver halide develoment) in that during the oxidation of hydroquinone by oxygen of the air in the presence of an alkali sulphite such as sodium sulphite the strong base sodium hydroxide is formed according to the reaction scheme presented in the above mentioned book of André Rott and Edith Weyde at p. 81.

According to a first embodiment said processing liquid contains (a) developing agent(s) for silver halide development and substantially none of such agents are present in the exposed photographic silver halide emulsion material and/or in the image-receiving element prior to said development.

According to a second embodiment at least part of the developing agent(s) is present in the photographic silver halide emulsion layer material before the material is photo-exposed and reaches the developable silver halide by diffusion with the aid of said processing liquid.

When incorporated in the photographic material, the developing agent(s) can be present in the silver halide emulsion layer or are preferably present in a hydrophilic colloid layer in water-permeable relationship therewith, e.g. in the antihalation layer adjacent to the silver halide emulsion layer of the photosensitive element.

A processing liquid that is initially free from developing agent(s) is called hereinafter "activator liquid".

Preferred tertiary aminoalkanols for use according to the present invention correspond to the following general formula I:

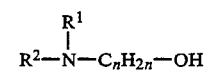

I wherein: each of $R^1$ and $R^2$ (same or different) represents a C1–C4 alkyl group or a hydroxy substituted C2–C4 alkyl group, or $R^1$ and $R^2$ together with the nitrogen atom whereto they are linked represent the necessary atoms to form a five or six membered saturated heterocyclic ring, and n represents 1, 2, 3 or 4.

Especially valuable representatives within the scope of the above general formula are listed in the following Table 1 with their pKa value. The notifications between brackets are used in the Example.

TABLE 1

| Compound No. | Structural formula | | pKa value |
|---|---|---|---|
| 1 | $CH_3-N(CH_3)-CH_2-CH_2-OH$ | (DMEA) | 9.31 |
| 2 | $CH_3-CH_2-N(CH_2-CH_3)-CH_2-CH_2-OH$ | (DEEA) | 9.59 |
| 3 | $CH_3-N(CH_2-CH_2-OH)-CH_2-CH_2-OH$ | (MDEA) | 8.52 |
| 4 | $CH_3-CH_2-N(CH_2-CH_2-OH)-CH_2-CH_2-OH$ | (EDEA) | 8.78 |

A single tertiary alkanolamine or a mixture of tertiary alkanolamines having different pKa values may be used in the processing liquid according to the present invention. They generally have a pKa value above 8.5. Preference is given in any instance to the use of at least one tertiary alkanolamine having a pKa value above 8.5.

Preferred secondary alkanolamines have a pKa value above 9.

Preferred representatives of secondary aminoalkanols for use according to the present invention correspond to the following general formula II:

$$H-N(R^1)-C_nH_{2n}-OH \qquad \text{II}$$

wherein:

$R^1$ represents a C1-C4 alkyl group or a hydroxy substituted C2-C4 alkyl group, and n represents 1, 2, 3 or 4.

Especially valuable representatives within the scope of the above general formula II are listed in the following Table 2 with their pKa value.

TABLE 2

| Compound No. | Structural formula | | pKa value |
|---|---|---|---|
| 1 | $CH_3-NH-CH_2-CH_2-OH$ | (MMEA) | 9.57 |
| 2 | $CH_3-CH_2-NH-CH_2-CH_2-OH$ | (MEEA) | 9.67 |
| 3 | $HO-CH_2-CH_2-NH-CH_2-CH_2-OH$ | (DEA) | 8.88 |
| 4 | $CH_3-CH(OH)-CH_2-NH-CH_2-CH(OH)-CH_3$ | (DIPA) | 8.88 |

For the determination by titration of the pKa values the alkanolamine involved is dissolved in water as the sole solvent.

The determination of the pKa values proceeded according to the description given by D. D. Perrin—Dissociation Constants of Organic Bases in Aqueous Solution—London Butterworths (1965).

A minor amount as defined of an inorganic base, e.g. sodium hydroxide, may bring the pH of the processing liquid in the range of 10 to 13 without a substantial increase in $CO_2$-absorption.

For ecological reasons and to avoid a decrease in swelling of the hydrophilic colloid binder of the materials to be processed the present processing liquid is preferably completely free from phosphate ions.

The optimum pH of the processing liquid according to the present invention depends on the type of silver halide emulsion material to be developed, intended development time and processing temperature.

The processing temperature may vary within broad ranges but is preferably in the range of 5° to 40° C.

The silver halide developing agent used in the process and processing liquid according to the present invention is preferably a p-dihydroxybenzene compound, e.g. hydroquinone, methylhydroquinone or chlorohydroquinone, preferably in combination with an auxiliary developing agent being a 1-phenyl-3-pyrazolidinone-type developing agent and/or p-monomethylaminophenol. When fairly low gradation images for continuous tone reproduction have to be produced preference is given to developing agent combinations as described in U.S. Pat. Nos. 3,985,561 and 4,242,436.

Preferably hydroquinone-type developing agents are present in the processing liquid according to the present invention in an amount of 0.05 to 0.25 tool per liter. 1-Phenyl-3-pyrazolidinone type developing agents may be present in an amount of $1.8\times10^{-3}$ to $2.0\times10^{-2}$ mol per liter. Particularly useful 1-phenyl-3-pyrazolidinone developing agents are 1-phenyl -3-pyrazol idinone, 1-phenyl -4-monomethyl -3-pyrazol idinone, 1-phenyl -4,4-dimethyl -3-pyrazol idinone, and 1-phenyl-4-methyl-4-hydroxymethyl-3-pyrazolidinone. The latter type of developing agents is advantageously present in the image receiving element.

A suitable quantitative combination of hydroquinone and at least one secondary or auxiliary developing agent of the class of 1-phenyl-3-pyrazolidinones and p-N-methyl-aminophenol comprises hydroquinone in an amount not lower than 0,078 tool per liter of aqueous alkaline solution and the secondary developing agent(s) in an amount not lower than 0.0080 mole per liter, the molar ratio of hydroquinone to said secondary developing agent(s) not being lower than 9.7. Preferred amounts of hydroquinone are in the range of 0.15 mole to 0.20 mole per liter and preferred amounts of secondary developing agent(s) in the range of 0.015 to 0. 020 mole per liter.

The sulphite ions preferably originate from an alkali metal sulphite such as potassium or sodium sulphite, but may originate likewise from a sulphite precursor, e.g. aldehyde bisulphite such as formaldehyde bisulphite, or mixtures of such sulphites.

For the DTR-process a silver halide solvent is indispensable. It may be supplied from the non-light-sensitive image-receiving element, but it is normally at least partly present already in the alkaline processing solution.

The silver halide solvent, which acts as a complexing agent for silver halide, preferably is a water-soluble thiosulphate or thiocyanate, e.g. sodium, potassium or ammonium thiosulphate or thiocyanate or mixtures thereof.

Other useful silver halide solvents are described in the book "The Theory of the Photographic Process" edited by T. H. James, 4th edition, p, 474–475 (1977), in particular sulphites and uracil, Further interesting silver halide solvents are described in U.S. Pat. Nos. 2,857,276 and 4,297,430, in particular cyclic iraides such as 5,5-dialkylhydantoins, Still further are mentioned alkyl sulphones and amines and alkanolamines which also act as silver halide solvents. Mixtures of silver halide solvents may be used in order to control the speed of silver complexing and following speed of transfer of the silver complexes, especially in the case of so-called mono-sheet elements as referred to hereinafter.

When present in the alkaline processing solution, the molar amount of thiosulphate compound is preferably in the range of 0.03 to 0,13 mol/l.

The alkaline processing solution preferably also contains (a) silver image toning agent(s) providing a neutral (black) image tone to the DTR-produced silver image in the image-receiving material. A survey of suitable toning agents is given in the above mentioned book of André Rott and Edith Weyde, p. 61–65, preference being given to 1-phenyl-1H-tetrazole-5-thiol, also called 1-phenyl-5-mercapto-tetrazole, tautomeric structures and derivatives thereof such as 1- (2,3-dimethylphenyl) -5-mercapto-tetrazole, 1-(3,4-dimethyl cyclohexyl ) -5-mercapto-tetrazole, 1-(4 -methylphenyl ) -5-mercapto-tetrazole, 1- (3-chloro-4-methyl phenyl) -5-mercapto-tetrazole, 1-(3,4-dichlorophenyl)-5-mercapto-tetrazole. Further particularly useful toning agents are of the class of thiohydantoins, preferably a compound corresponding to the following structural formula:

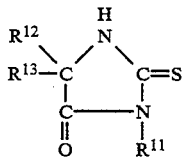

wherein: $R^{11}$ represents an allyl group, and each of $R^{12}$ and $R^{13}$ (same or different) represents an alkyl group, e.g. methyl group.

Other particularly useful silver image toning agents are in the class of phenol substituted mercapto-triazoles, a preferred representative corresponding to the following structural formula:

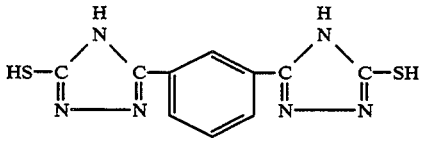

For DTR-processing the aqueous alkaline processing solution according to the present invention comprises (a) toning agent(s) in a concentration in a range e.g. from 30 mg to 200 mg per liter.

Other additives are thickening agents, e.g. hydroxyethyl cellulose and carboxymethylcellulose, fog inhibiting agents, e.g. potassium bromide, potassium iodide and a benzotriazole, calcium-sequestering compounds, wetting agents, e.g. block copolymers of ethyleneoxide and propylene oxide, anti-sludge agents, and hardeners including latent hardeners.

The DTR-image can be formed in the image-receiving layer of a sheet or web material being a separate element with respect to the photographic silver halide emulsion material or in a so-called single-support-element, also called mono-sheet element or unitary DTR-material, which contains at least one photographic silver halide emulsion layer and the image-receiving layer in waterpermeable relationship therewith, e.g. on top of each other or separated by a thin waterpermeable stripping layer or alkali-degradable interlayer as described e.g. in US-P 3,684,508 or wherein the photographic silver halide emulsion layer is optically masked from the image-receiving layer, e.g. with a white waterpermeabl e pigment layer as described e.g. in U.S. Pat. Nos. 3,607,270 and 3,740,220.

The support of the image receiving material may be opaque or transparent, e.g. a paper support or resin support.

The image receiving layer comprises for best imaging results physical development nuclei normally in the presence of a protective hydrophilic colloid, e.g. gelatin and/or colloidal silica.

Preferred development nuclei are sulphides of heavy metals e.g. sulphides of antimony, bismuth, cadmium, cobalt, lead, nickel, palladium, platinum, silver, and zinc. Especially suitable development nuclei are NiS-.$Ag_2S$ nuclei as described in U.S. Pat. No. 4,563,410. Other suitable development nuclei are salts such as e.g. selenides, polyselenides, polysulphides, mercaptans, and tin (II) halides. Heavy metals or salts thereof and fogged silver halide are suitable as well. The complex salts of lead and zinc sulphides are active both alone and when mixed with thioacetamide, dithiobiuret, and dithiooxamide. Heavy metals, preferably silver, gold, platinum, palladium, and mercury can be used in colloidal form.

The image-receiving element may contain in operative contact with the development nuclei thioether compounds, e.g. these described in DE-P 1,124,354, in U.S. Pat. Nos. 4,013,471 and 4,072,526, and in published European Patent Application (EP-A) 0 026 520. Other compounds improving the neutrality of the image tone are silver image toning agents, e.g. the compounds described in the above mentioned book of André Rott and Edith Weyde, p. 61–65 and in published European Patent Applications Nos. 0 218 752, 0 218 753 and 0 208 346.

Most of the DTR-positive materials now available on the market are composed of two or even three layers. Such materials normally contain on top of the nuclei containing layer a layer which itself contains no nuclei and otherwise has the same composition as the nuclei containing layer and mainly serves to ensure good contact between the negative and positive material during transfer. Moreover, after drying this layer provides a protective coating for the image receiving layer containing the silver image. It further prevents bronzing or plumming of the black image areas in preventing the protruding of silver from the image receiving layer in the form of a glossy silver mirror (ref. the above mentioned book p. 50).

According to a preferred embodiment not only the processing liquid but also the image-receiving element contains at least one image toning agent. In said case the image toning agent(s) may gradually transfer by diffusion from said image-receiving element into the processing liquid and keep therein the concentration of said agents almost steady. In practice such can be realized by using the above defined silver image toning agents in a coverage in the range from 1 mg/m$^2$ to 10 mg/m$^2$ in a hydrophilic waterpermeable colloid layer of the image-receiving material containing 1 g of gelatine per m$^2$. According to a practical embodiment in the image-receiving element the development nuclei containing layer and/or hydrophilic colloid layer in waterpermeable relationship therewith and/or back layer coated at the side of the support opposite to that carrying the image-receiving layer contains at least part of the silver image toning agents used in the present process. Such procedure results actually in automatic replenishment of toning agent in the processing liquid. The same applies at least partly for the replenishment of the developing agent(s) and silver halide complexing agent(s).

According to another embodiment at least a part of said silver image toning agents is present in the silver halide emulsion material to be developed. Such means that in a practical embodiment at least one of the image toning agents may be used in a hydrophilic waterpermeable colloid layer, e.g. antihalation layer at the side of the support opposite to the side coated with a silver halide emulsion layer or between the silver halide emulsion layer and the support. The coverage of said silver image toning agents in said antihalation layer is preferably in the range of 1 mg/m$^2$ to 10 mg/m$^2$.

The transfer behaviour of the complexed silver largely depends on the thickness of the image-receiving layer and the kind of binding agent or mixture of binding agents used in the nuclei containing layer. In order to obtain a sharp image with high spectral density the reduction of the silver salts diffusing into the image receiving layer must take place rapidly before lateral diffusion becomes substantial.

An image-receiving material satisfying said purpose is described in published European Patent Application 87201700.9 and is particularly suitable for being processed according to the present invention.

An image-receiving material of this type particularly suited for use according to the present invention contains a water-impermeable support coated with (1) an image-receiving layer containing physical development nuclei dispersed in a waterpermeable binder and (2) a waterpermeable top layer free from development nuclei and containing a hydrophilic colloid, in such a way that:

(i) the total solids coverage of said two layers (1) and (2) is at most 2 g/m2, (ii) in layer (1) the coverage of said nuclei is in the range of 0.1 mg/m2 to 10 mg/m2, and the coverage of binder is in the range of 0.4 to 1.5 g/m2, and (iii) in said top layer (2) the coverage of hydrophilic colloid is in the range of 0.1 to 0.9 g/m2.

The coating of said layers proceeds preferably with slide hopper coater or curtain coater known to those skilled in the art.

A white appearance of the image background even when a yellow stain should appear on storage is obtained by incorporation of optical brightening agents in the support, image-receiving layer and/or interlayer between the support and the image-receiving layer.

According to a particular embodiment the nuclei containing layer (1) is present on a nuclei-free underlying hydrophilic colloid undercoat layer or undercoat layer system having a coverage in the range of 0.1 to I g/m2 of hydrophilic colloid, the total solids coverage of layers (1) and (2) together with the undercoat being at most 2 g/m2.

The undercoat optionally incorporates substances that improve the image quality, e.g. incorporates a substance improving the image-tone or the whiteness of the image background. For example, the undercoat may contain a fluorescent substance, silver complexing agent(s) and/or development inhibitor releasing compounds known for improving image sharpness.

According to a special embodiment the image-receiving layer (1) is applied on an undercoat playing the role of a timing layer in association with an acidic layer serving for the neutralization of alkali of the image-receiving layer. By the timing layer the time before neutralization occurs is established, at least in part, by the time it takes for the alkaline processing composition to penetrate through the timing layer. Materials suitable for neutralizing layers and timing layers are disclosed in Research Disclosure July 1974, item 12331 and July 1975, item 13525.

In the image-receiving layer (1) and/or in said top layer (2) and/or in an undercoat gelatin is used preferably as hydrophilic colloid. In layer (1) gelatin is present preferably for at 1 east 60% by weight and i s optionally used in conjunction with an other hydrophilic colloid, e.g. polyvinyl alcohol, cellulose derivatives, preferably carboxymethyl cellulose, dextran, gallactomannans, alginic acid derivatives, e.g. alginic acid sodium salt and/or watersoluble polyacrylamides. Said other hydrophilic colloid may be used also in the top layer for at most 10% by weight and in the undercoat in an amount lower than the gelatin content.

The image-receiving layer and/or a hydrophilic colloid layer in water-permeable relationship therewith may comprise a silver halide developing agent and/or silver halide solvent, e.g. sodium thiosulphate in an amount of approximately 0.1 g to approximately 4 g per m$^2$.

The image-receiving layer or a hydrophilic colloid layer in water-permeable relationship therewith may comprise colloidal silica.

The image-receiving layer may contain as physical development acceleratots, in operative contact with the developing nuclei, thioether compounds such as those described e.g. in DE A 1,124,354; U.S. Pat. Nos. 4,013,471; 4,072,526; and in EU A 0,026,520.

When applying an optical brightening agent in the image-receiving material preference is given to an optical brightening agent that is inherently by its structure resistant to diffusion or is made resistant to diffusion by use in conjunction with another substance wherein it is dissolved or whereto it is adsorbed.

For example, to make an optical brightening agent resistant to diffusion one of the following techniques may be applied.

According to a first technique known from colour photography the optical brightening compound is substituted with a long chain aliphatic residue and ionomeric residue as is known in the synthesis of diffusion resistant col our couplers.

According to a second technique an optical brightening agent of the oleophilic type is incorporated in droplets of a water-immiscible solvent, so-called "oil-former", e.g. dibutylphthalate.

According to a third technique the optical brightening agent is used in conjunction with a polymeric hydrophilic colloid adsorber, a so-called trapping agent, e.g. poly-N-vinylpyrrolidinone as described e.g. in U.S.

Pat. Nos. 3,650,752, 3,666,470 and 3,860,427 and published European patent application 0 106 690.

According to a fourth technique latex compositions are used wherein latex particles are loaded, i.e. contain in dissolved and/or adsorbed state an optical brightening agent as described e.g. in German Offenlegungsschrift (DE-OS) 1,597,467 and in U.S. Pat. No. 4,388,403.

The image-receiving layer and/or other hydrophilic colloid layer of an image-receiving material used in a DTR-process according to the present invention may have been hardened to some extent to achieve enhanced mechanical strength. Appropriate hardening agents for hardening the natural and/or synthetic hydrophilic colloid binding agents in the image-receiving layer include e.g. formaldehyde, glyoxal, mucochloric acid, and chrome alum. Other suitable hardening agents for hardening the hydrophilic colloid binding agents in the image-receiving layer are vinylsulphonyl hardeners, e.g. as described in Research Disclosure 22,507 of Jan. 1983.

According to a preferred embodiment hardening is effected by incorporating a hardener precursor in the image-receiving layer, the hardening of the hydrophilic colloid therein being triggered by the treatment with the alkaline processing liquid.

In the process of the present invention the image-receiving material can be used in the form of roll film or sheet film or in the form of a filmpack e.g., for in-camera-processing.

The image-receiving material can be used in conjunction with any type of photographic silver halide emulsion material suited for use in diffusion transfer reversal processing. The silver halide emulsion material may contain one or more hydrophilic colloid—silver halide emulsion layers.

In the photographic material to be processed after exposure with a processing solution according to the present invention whether or not in combination with a DTR-image-receiving material, the hydrophilic colloid silver halide emulsion layer can be coated from any photosensitive silver halide emulsion comprising a hydrophilic colloid binder, which usually is gelatin. But instead of or together with gelatin, use can be made of one or more other natural and/or synthetic hydrophilic colloids, e.g. albumin, casein, zein, polyvinyl alcohol, alginic acids or salts thereof, cellulose derivatives such as carboxymethyl cellulose, modified gelatin, e.g. phthaloyl gelatin etc. The weight ratio of hydrophilic colloid binder to silver halide expressed as equivalent amount of silver nitrate to binder is e.g. in the range of 1:1 to 10:1.

The photosensitive silver halide used in the present invention may comprise silver chloride, silver bromide, silver bromoiodide, silver chlorobromoiodide and the like, or mixtures thereof. To obtain a sufficiently high rate of solution of the silver halide and a satisfactory gradation necessary for graphic purposes a silver halide emulsion mainly comprising silver chloride is used preferably. This silver chloride emulsion may comprise minor amounts of silver bromide and/or silver iodide.

The silver halide emulsions may be coarse or fine grain and can be prepared by any of the well known procedures e.g. single jet emulsions, double jet emulsions such as Lippmann emulsions, ammoniacal emulsions, thiocyanate- or thioether-ripened emulsions such as those described in U.S. Pat. Nos. 2,222,264, 3,320,069, and 3,271,157. Surface image emulsions may be used or internal image emulsions may be used such as those described in U.S. Pat. Nos. 2,592,250, 3,206,313, and 3,447,927. If desired, mixtures of surface and internal image emulsions may be used as described in U.S. Pat. No. 2,996,382.

The silver halide particles of the photographic emulsions may have a regular crystalline form such as cubic or octahedral form or they may have a transition form. Regular-grain emulsions are described e.g. in J. Photogr. Sci., Vol. 12, No. 5, Sept./Oct, 1964, pp. 242–251. The silver halide grains may also have an almost spherical form or they may have a tabular form (so-called T-grains), or may have composite crystal forms comprising a mixture of regular and irregular crystalline forms. The silver halide grains may have a multilayered structure having a core and shell of different halide composition. Besides having a differently composed core and shell the silver halide grains may comprise also different halide compositions and metal dopants inbetween.

Two or more types of silver halide emulsions that have been prepared differently can be mixed for forming a photographic emulsion for use in a photographic material treated with a processing liquid according to the present invention.

The average size of the silver halide grains may range from 0.2 to 1.2 $\mu$m, and the size distribution can be homodisperse or heterodispere. A homodisperse size distribution is obtained when 95% of the grains have a size that does not deviate more than 30% from the average grain size.

Apart from negative-working silver halide emulsions that are preferred for their high light-sensitivity, use can be made also of direct-positive silver halide emulsions that produce a positive silver image.

For instance, direct-positive emulsions of the type described in U.S. Pat. No. 3,062,651 may be employed. In direct-positive emulsions a non-hardening fogging agent such as stannous chloride and formamidine sulphinic acid can be used.

The emulsions can be chemically sensitized e.g. by adding sulphur-containing compounds during the chemical ripening stage e.g. allyl isothiocyanate, allyl thiourea, and sodium thiosulphate. Also reducing agents e.g. the tin compounds described in BE-A 493,464 and 568,687, and polyamines such as diethylene triamine or derivatives of aminomethane-sulphonic acid can be used as chemical sensitizers. Other suitable chemical sensitizers are noble metals and noble metal compounds such as gold, platinum, palladium, iridium, ruthenium and rhodium. This method of chemical sensitization has been described in the article of R. KOSLOWSKY, Z. Wiss. Photogr. Photophys. Photochem. 46, 65–72 (1951).

The emulsions can also be sensitized with polyalkylene oxide derivatives, e.g. with polyethylene oxide having a molecular weight of 1000 to 20,000, or with condensation products of alkylene oxides and aliphatic alcohols, glycols, cyclic dehydration products of hexitols, alkyl-substituted phenols, aliphatic carboxylic acids, aliphatic amines, aliphatic diamines and amides. The condensation products have a molecular weight of at least 700, preferably of more than 1000. It is also possible to combine these sensitizers with each other as described in BE-A 537,278 and GB-A 727,982.

The spectral photosensitivity of the silver halide can be adjusted by proper spectral sensitization by means of the usual mono- or polymethine dyes such as acidic or basic cyanines, hemicyanines, oxonols, hemioxonols, styryl dyes or others, also tri- or polynuclear roethine dyes e.g. rhodacyanines or neocyanines. Such spectral sensitizers have been described by e.g. F. M. HAMER in "The Cyanine Dyes and Related Compounds" (1964) Interscience Publishers, John Wiley & Sons, New York.

The silver halide emulsions may contain the usual stabilizers e.g. homopolar or salt-like compounds of mercury with aromatic or heterocyclic rings such as mercaptotriazoles, simple mercury salts, sulphonium mercury double salts and other mercury compounds. Other suitable stabilizers are azaindenes, preferably tetra- or penta-azaindenes, especially those substituted with hydroxy or amino groups. Compounds of this kind have been described by BIRR in Z. Wiss. Photogr. Photophys. Photochem. 47, 2–27 (1952). Other suitable stabilizers are i.a. heterocyclic mercapto compounds e.g. phenylmercaptotetrazole, quaternary benzothiazole derivatives, and benzotriazole.

Either or not in combination with one or more developing agents into the silver halide emulsions may contain pH controlling ingredients, and other ingredients such as antifogging agents, development accelerators, wetting agents, and hardening agents for gelatin.

The silver halide emulsion layer may comprise light-screening dyes that absorb scattering light and thus promote the image sharpness and, as a consequence thereof, the sharpness of the final printed copy. Light-absorbing dyes that can be used as light-screening dyes have been described in i.a. U.S. Pat. Nos. 4,092,168, 4,311,787, DE-A 2,453,217, and GB-A 7,907,440. More details about the composition, preparation and coating of silver halide emulsions can be found in e.g. Product Licensing Index, Vol. 92, December 1971, publication 9232, p. 107–109.

As an interesting variant in the DTR-process the silver halide emulsion may consist of a first light-sensitive silver halide emulsion in which a normal latent image is formed upon image-wise exposure and a second silver halide emulsion whose speed is so low that no or almost no latent image is formed therein. When the low-speed silver halide emulsion and the light-sensitive silver halide emulsion are coated to form different layers, the resulting emulsion layers are arranged in DTR-processing in such a way that the low-speed emulsion is remotest from the image-receiving layer. It is also possible to coat one single layer comprising a mixture of both types of emulsion.

By the combination of light-sensitive and low-speed emulsions a silver image having an enhanced contrast can be obtained. Such may be explained by the fact that upon application of an aqueous alkaline solution to the image-wise exposed light-sensitive silver halide emulsion layer system in the presence of a developing agent and a silver halide solvent a silver image is formed in the image-receiving layer from the additionally obtained silver complexes in the low-speed emulsion layer. No image-background staining in the DTR-print takes place because the reduced silver of the light-sensitive emulsion forms a barrier for silver halide or complexes of the low-speed emulsion that would also tend to migrate towards the image-receiving element. As a result, the silver halide or complexes thereof diffusing from both the light-sensitive emulsion and the low-speed emulsion together build up said strenghtened high-contrast silver image in the image receiving layer.

As the sensitivity of the low speed emulsion must be low enough to be inert in the photo-exposure, no second ripening or after-ripening thereof is applied.

The low-speed emulsion may be a pure silver chloride emulsion or an emulsion of mixed silver halides comprising silver chloride e.g. a silver chlorobromide or chlorobromoiodide emulsion. However, the low-speed emulsion is preferably a silver chloride emulsion for the greater part. Preferably a fine-grain silver chloride having a particle size in the range of 50 to 500 nm is used.

In case a mixture of low-speed emulsion and of imaging emulsion is coated to form one single layer, the amount of low-speed emulsion may vary within wide limits. Favourable results can be obtained when the ratio of low-speed silver chloride-containing emulsion to image-forming emulsion, expressed in parts by weight of silver nitrate, ranges from 10:1 to 1:1. The amount of low-speed emulsion to be added depends i.a. on its own nature, on the type of image-forming emulsion used, and on the effect desired. It can be determined easily by routineers in the art by making a few comparative tests.

The silver halide emulsion coated side of the photographic material can be provided with a top layer that contains hydrophilic colloids that form a waterpermeable layer. Such top layer is usually free of gelatin. Its nature is such that it does not inhibit or restrain the diffusion transfer of the complexed silver but acts e.g. as an anti-stress layer. Appropriate hydrophilic binding agents for such top layer are e.g. methyl cellulose, the sodium salt of carboxymethyl cellulose, hydroxyethyl cellulose, hydroxyethyl starch, hydroxypropyl starch, sodium alginate, gum tragacanth, starch, polyvinyl alcohol, polyacrylic acid, polyacrylamide, poly-N-vinyl pyrrolidinone, polyoxyethylene, and copoly(methylvinylether/maleic acid). The thickness of this layer depends on the nature of the colloid used and the required mechanical strength. Such layer if present may be transferred at least partially to the image-receiving layer without deleterious action on the image formation.

The development and diffusion transfer can be initiated in different ways e.g. by rubbing with a roller that has been wetted with the processing liquid, e.g. acts as meniscus coater, by wiping with an absorbent means e.g. with a plug of cotton or sponge, or by dipping the material to be treated in the liquid composition. Preferably, they proceed in an automatically operated apparatus such as the COPYPROOF (registered trade name of AGFA-GEVAERT N.V. Belgium) type CP 38, CP 380, CP 42 or CP 530 processors. The DTR-process is normally carried out at a temperature in the range of 10° C. to 35° C.

In the following Examples the invention is illustrated with regard to the DTR-processing. However, as referred to hereinbefore the processing liquid according to the present invention can be used for the processing of exposed photographic silver halide emulsion materials in general.

The following Examples illustrate the present invention without however, limiting it thereby. All parts, percentages and ratios are by weight unless otherwise indicated.

EXAMPLE 1

Comparative example

Preparation of negative working silver halide emulsion material (N)

A paper support having a weigth of 110/m$^2$ being coated at both sides with a polyethylene layer was coated at one side with an antihalation layer on the basis of carbon black dispersed in gelatin wherein also hydroquinone and 1-phenyl-4-methyl-pyrazolidin-3-on were present in a coverage of 1 g/m$^2$ and 0.3 g/m$^2$ respectively. On said antihalation layer an orthochromatically sensitized negative working gelati no silver halide emulsion layer containing an amount of silver chlorobromide (1.8 mol % bromide) equivalent to 2.0 g/m$^2$ of silver nitrate was coated. The average grain size of the silver chlorobromide was 0.3 microns. The silver halide emulsion layer was overcoated with thin protective gelatin layer.

Preparation of image-receiving material (A)

One side of a paper support having a weight of 110 g/m$^2$and being coated at both sides with a polyethylene layer was coated at a dry coverage of 2 g/m$^2$ with an image-receiving layer containing silver-nickel sulphide nuclei and gelatin.

Preparation of image-receiving material (B)

A subbed polyethylene terephthalate film support was coated at one side at a dry coverage of 1.8 g/m2 with an image-receiving layer containing silver-nickel sulphide nuclei dispersed in gelatin.

Exposure procedure

The photographic materials were exposed through a sensitometric wedge in a contact exposure apparatus operating with a light source having a colour temperature of 3200° K.

DTR-transfer procedure

The exposed photographic materials were pre-moistened with the hereinafter defined processing liquids, the separate contact time with said liquid called hereinafter retention time (RT) was 6 seconds. Following the retention time the moistened photographic materials were pressed together with one of the image-receiving materials (A) or (B) as defined above and kept in contact therewith for a period called transfer time (TT) which was 30 seconds for the paper type image receiving materials and 60 seconds for the resin film type image receiving materials. The transfer processor employed was a COPY PROOF (registered trade name of AGFA-GEVAERT N.V.) type CP 380. Several transfers were carried out at different processing liquid temperatures which were 10°, 20° and 30° C. respectively.

The influence of the actual $CO_2$-absorption on the image quality was evaluated by processing 10 sets of photographic material (N) with image-receiving material (A) and (B) respectively with processing liquids that had been exposed before use for 21 and 42 hours respectively to an atmosphere containing 5000 ppm of $CO_2$. The $CO_2$-atmosphere was obtained in a box with an air flow of 2.5 l/min enriched with 5000 ppm of $CO_2$.

The obtained test wedge prints in the image-receiving materials were evaluated with regard to maximum density ($D_{max}$), yellow stain of image background and gradation (gamma-value) (see Tables III to XIV).

Composition of activator processing solutions

| Ingredient | A | B | C | D | E | F |
|---|---|---|---|---|---|---|
| I (g) | 1.0 | id | id | id | id | id |
| II (g) | 60.0 | id | id | id | id | id |
| III (g) | 12.5 | id | id | id | id | id |
| IV (g) | 1.0 | id | id | id | id | id |
| V (g) | 0.05 | id | id | id | id | id |
| DEEA (ml) | 80 | 0 | 0 | 0 | 0 | 0 |
| MDEA (ml) | 0 | 69 | 0 | 0 | 0 | 0 |
| DEA (ml) | 0 | 0 | 57.5 | 0 | 0 | 0 |
| DIPA (ml) | 0 | 0 | 0 | 79.5 | 0 | 0 |
| TEA (ml) | 0 | 0 | 0 | 0 | 80.0 | 40.0 |
| MMEA (ml) | 0 | 0 | 0 | 0 | 0 | 24.0 |
| Water up to 1 l | id | id | id | id | id | id |

I: Ethylenediaminetetraacetic acid tetrasodium salt
II: $NA_2SO_3$ (anhydrous), [60 g of $NA_2SO_3$ contains 38.09 g of $SO_3^{--}$ ions].
III: $NA_2S_2O_3$ (anhydrous)
IV: KBr
V: 1-Phenyl-5-mercapto-tetrazole
TEA: triethanolamine (pKa value: 7.6)

Evaluation

All wedge prints were measured on a densitometer MACBETH (registered trade name) type TR 924 behind visual filter, having following wavelength (nm)/optical density (D) characteristics:
700 nm/D=0; 600 nm/D=0.2; 500 nm/D=1.25; 420 nm/D=3.

For the DTR-prints obtained on paper base image-receiving materials maximum reflection density was measured ($D_{max}$ R), the sensitivity expressed in relative log exposure values (tel. log E) determined at 0.10 above fog level ($D_{min}$ R), and the gamma value (maximum gradient of the straigth line portion of the sensitometric curve). The reflection density measurement proceeded according to American National Standard for Photography (Sensitometry) ANSI PH2.17-1985.

For the DTR-prints obtained on transparent resin film base image-receiving materials maximum transmission density was measured ($D_{max}$ T), the sensitivity expressed in relative log exposure values (tel. log E) determined at 0.10 above fog level ($D_{min}$ T), and the gamma value (maximum gradient of the straigth line portion of the sensitometric curve). The transmission density measurement proceeded according to American National Standard for Photography (Sensitometry) ANSI PH2.19-1986.

The yellow stain of the non-silver image parts (image background) was assessed visually and given rating numbers from 1 to 6, wherein the higher numbers stand for a more pronounced yellow stain.

TABEL III

Sensitometric results of prints on paper base image-receiving materials
Processing temperature
10° C. - $CO_2$-exposure: 0 h.

| Processing solution | $D_{max}$ R | rel. log E | gamma | stain rating number |
|---|---|---|---|---|
| A | 1.82 | 0.52 | 13.1 | 1 |
| B | 1.80 | 0.39 | 7.9 | 1 |
| C | 1.71 | 0.44 | 12.4 | 1 |
| D | 1.73 | 0.40 | 8.6 | 1 |
| E | 1.42 | 0.33 | 2.4 | 6 |
| F | 1.80 | 0.47 | 15.0 | 1 |

TABEL IV

Sensitometric results of prints on paper base image-receiving materials
Processing temperature
20° C. - $CO_2$-exposure: 0 h.

| Processing solution | $D_{max}$ R | rel. log E | gamma | stain rating number |
|---|---|---|---|---|
| A | 1.78 | 0.58 | 22.7 | 1 |
| B | 1.82 | 0.52 | 11.4 | 1 |
| C | 1.57 | 0.57 | 15.4 | 1 |
| D | 1.74 | 0.52 | 13.4 | 1 |
| E | 1.91 | 0.47 | 8.8 | 1 |
| F | 1.62 | 0.58 | 16.2 | 1 |

TABEL V

Sensitometric results of prints on paper base image-receiving materials
Processing temperature
30° C. - $CO_2$-exposure: 0 h.

| Processing solution | $D_{max}$ R | rel. log E | gamma | stain rating number |
|---|---|---|---|---|
| A | 1.76 | 0.57 | 31.8 | 1 |
| B | 1.79 | 0.53 | 15.7 | 1 |
| C | 1.52 | 0.58 | 22.8 | 1 |
| D | 1.66 | 0.52 | 17.5 | 1 |
| E | 1.83 | 0.40 | 9.1 | 1 |
| F | 1.65 | 0.56 | 20.7 | 1 |

TABEL VI

Sensitometric results of prints on paper base image-receiving materials
Processing temperature
10° C. - $CO_2$-exposure: 42 h.

| Processing solution | $D_{max}$ R | rel. log E | gamma | stain rating number |
|---|---|---|---|---|
| A | 1.73 | 0.48 | 9.0 | 1 |
| B | 1.68 | 0.41 | 5.0 | 1 |
| C | 1.34 | 0.41 | 3.3 | 6 |
| D | 1.26 | 0.38 | 2.6 | 6 |
| E | 0.88 | 0.41 | 1.1 | 6 |
| F | 0.88 | 0.42 | 1.9 | 6 |

TABEL VII

Sensitometric results of prints on paper base image-receiving materials
Processing temperature
20° C. - $CO_2$-exposure: 42 h.

| Processing solution | $D_{max}$ R | rel. log E | gamma | stain rating number |
|---|---|---|---|---|
| A | 1.99 | 0.52 | 17.1 | 1 |
| B | 1.90 | 0.47 | 10.7 | 1 |
| C | 1.78 | 0.43 | 7.1 | 1 |
| D | 1.87 | 0.41 | 7.7 | 1 |
| E | 1.55 | 0.38 | 5.2 | 1 |
| F | 1.71 | 0.39 | 5.5 | 6 |

TABEL VIII

Sensitometric results of prints on paper base image-receiving materials
Processing temperature
30° C. - $CO_2$-exposure: 42 h.

| Processing solution | $D_{max}$ R | rel. log E | gamma | stain rating number |
|---|---|---|---|---|
| A | 1.93 | 0.60 | 25.6 | 1 |
| B | 1.90 | 0.54 | 13.5 | 1 |
| C | 1.75 | 0.46 | 7.5 | 1 |
| D | 1.85 | 0.47 | 8.8 | 1 |
| E | 1.88 | 0.45 | 5.9 | 1 |
| F | 1.89 | 0.43 | 6.6 | 1 |

TABEL IX

Sensitometric results of prints on film base image-receiving materials
Processing temperature
10° C. - $CO_2$-exposure: 0 h.

| Processing solution | $D_{max}$ T | rel. log E | gamma |
|---|---|---|---|
| A | 3.51 | 0.59 | 16.0 |
| B | 2.60 | 0.48 | 9.0 |
| C | 3.37 | 0.45 | 13.1 |
| D | 2.58 | 0.40 | 8.9 |
| E | 1.34 | 0.34 | 1.4 |
| F | 3.48 | 0.48 | 15.0 |

TABEL X

Sensitometric results of prints on film base image-receiving materials
Processing temperature
20° C. - $CO_2$-exposure: 0 h.

| Processing solution | $D_{max}$ T | rel. log E | gamma |
|---|---|---|---|
| A | 3.67 | 0.59 | 17.7 |
| B | 3.59 | 0.54 | 15.0 |
| C | 3.97 | 0.58 | 18.1 |
| D | 3.43 | 0.55 | 16.5 |
| E | 2.96 | 0.49 | 10.7 |
| F | 3.86 | 0.60 | 19.2 |

TABEL XI

Sensitometric results of prints on film base image-receiving materials
Processing temperature
30° C. - $CO_2$ exposure: 0 h.

| Processing solution | $D_{max}$ T | rel. log E | gamma |
|---|---|---|---|
| A | 3.66 | 0.59 | 17.4 |
| B | 3.71 | 0.53 | 17.5 |
| C | 3.89 | 0.64 | 17.4 |
| D | 3.69 | 0.53 | 17.1 |
| E | 3.55 | 0.42 | 12.8 |
| F | 3.84 | 0.57 | 18.4 |

TABEL XII

Sensitometric results of prints on film base image-receiving materials
Processing temperature
10° C. - $CO_2$ exposure: 42 h.

| Processing solution | $D_{max}$ T | rel. log E | gamma |
|---|---|---|---|
| A | 2.30 | 0.50 | 10.2 |
| B | 2.37 | 0.46 | 7.1 |
| C | 1.71 | 0.39 | 4.9 |
| D | 1.74 | 0.39 | 5.3 |
| E | 1.15 | 0.38 | 2.6 |
| F | 1.16 | 0.39 | 3.8 |

TABEL XIII

Sensitometric results of prints on film base image-receiving materials
Processing temperature
20° C. - $CO_2$-exposure: 42 h.

| Processing solution | $D_{max}$ T | rel. log E | gamma |
|---|---|---|---|
| A | 3.30 | 0.54 | 17.6 |
| B | 3.11 | 0.47 | 12.3 |
| C | 2.61 | 0.44 | 8.3 |
| D | 2.83 | 0.45 | 10.1 |
| E | 2.00 | 0.42 | 6.3 |
| F | 2.32 | 0.42 | 7.6 |

TABEL XIV

Sensitometric results of prints on film base image-receiving materials
Processing temperature
30° C. - $CO_2$-exposure: 42 h.

| Processing solution | $D_{max}$ T | rel. log E | gamma |
|---|---|---|---|
| A | 3.72 | 0.61 | 22.5 |
| B | 3.47 | 0.56 | 16.2 |
| C | 3.01 | 0.48 | 10.5 |
| D | 3.35 | 0.50 | 13.4 |
| E | 2.82 | 0.47 | 8.0 |
| F | 2.84 | 0.44 | 8.9 |

The processing solutions A and B within the scope of the present invention show a better temperature latitude (high $D_{max}$, high gradation and an almost constant sensitivity) compared with comparative processing solutions C, D, E and F.

After 42 h of $CO_2$-absorption the temperature latitude remains very good for the processing solutions A and B and is markedly less for solutions C, D, E and F, especially for the lower processing temperatures.

EXAMPLE 2

Example 1 was repeated with the difference however, that the following activator processing solution were used.

Composition of activator processing solutions

| Ingredient | A | B | C | D | E | F |
|---|---|---|---|---|---|---|
| I (g) | 0.6 | id | id | id | id | id |
| II (g) | 1.0 | id | id | id | id | id |
| III (g) | 2.0 | id | id | id | id | id |
| IV (g) | 45.0 | id | id | id | id | id |
| V (g) | 14.0 | id | id | id | id | id |
| VI (g) | 0.5 | id | id | id | id | id |
| VII (g) | 0.100 | id | id | id | id | id |
| VIII (g) | 0.020 | id | id | id | id | id |
| DEEA (ml) | 80.0 | 0 | 0 | 66.5 | 0 | 0 |
| DMEA (ml) | 0 | 60.0 | 0 | 0 | 50.0 | 0 |
| DEA (ml) | 0 | 0 | 57.5 | 0 | 0 | 48 |
| MMEA (ml) | 0 | 0 | 0 | 8.0 | 8.0 | 8.0 |
| Water up to 1 l | id | id | id | id | id | |

I: Copolymer of ethylene oxide and propylene oxide (wetting agent)
II: Hydroxyethylcellulose
III: Ethylenediaminetetraacetic acid tetrasodium salt
IV: $NA_2SO_3$ (anhydrous), [45 g of $NA_2SO_3$ contains 28.57 g of $SO_3^{--}$].
V: $NA_2S_2O_3$ (anyhdrous)
VI: KBr
VII: 1-Phenyl-5-mercapto-tetrazole
VIII: 1-(3,4-dichlorophenyl)-2-tetrazolin-5-thione The obtained test wedge prints in the image-receiving materials were evaluated with regard to maximum density ($D_{max}$), yellow stain of image background and gradation (gamma-value) (see Tables 1 to 12).

TABEL 1

Sensitometric results of prints on paper base image-receiving materials
Processing temperature
10° C. - $CO_2$-exposure: 0 h.

| Processing solution | $D_{max}$ R | rel. log E | gamma | stain rating number |
|---|---|---|---|---|
| A | 1.85 | 0.56 | 23.8 | 1 |
| B | 1.91 | 0.55 | 18.2 | 1 |
| C | 1.74 | 0.52 | 12.9 | 1 |
| D | 1.86 | 0.56 | 21.1 | 1 |
| E | 1.89 | 0.56 | 19.5 | 1 |
| F | 1.74 | 0.55 | 15.7 | 1 |

TABEL 2

Sensitometric results
of prints on paper base image-receiving materials
Processing temperature 20° C. - $CO_2$-exposure: 0 h.

| Processing solution | $D_{max}$ R | rel. log E | gamma | stain rating number |
|---|---|---|---|---|
| A | 1.77 | 0.59 | 27.1 | 1 |
| B | 1.84 | 0.61 | 29.8 | 1 |
| C | 1.62 | 0.58 | 20.6 | 1 |
| D | 1.75 | 0.60 | 29.2 | 1 |
| E | 1.77 | 0.59 | 26.0 | 1 |
| F | 1.62 | 0.59 | 23.9 | 1 |

TABEL 3

Sensitometric results
of prints on paper base image-receiving materials
Processing temperature 30° C. - $CO_2$-exposure: 0 h.

| Processing solution | $D_{max}$ R | rel. log E | gamma | stain rating number |
|---|---|---|---|---|
| A | 1.73 | 0.67 | 36.4 | 1 |
| B | 1.74 | 0.66 | 41.4 | 1 |
| C | 1.61 | 0.66 | 32.9 | 1 |
| D | 1.70 | 0.67 | 35.2 | 1 |
| E | 1.74 | 0.67 | 38.3 | 1 |
| F | 1.60 | 0.67 | 35.2 | 1 |

TABEL 4

Sensitometric results
of prints on paper base image-receiving materials
Processing temperature 10° C. - $CO_2$-exposure: 42 h.

| Processing solution | $D_{max}$ R | rel. log E | gamma | stain rating number |
|---|---|---|---|---|
| A | 1.97 | 0.52 | 17.3 | 1 |
| B | 1.97 | 0.53 | 20.7 | 1 |
| C | 1.81 | 0.40 | 6.3 | 3 |
| D | 1.99 | 0.53 | 11.3 | 2 |
| E | 2.03 | 0.51 | 10.4 | 2 |
| F | 1.91 | 0.40 | 3.8 | 3 |

TABEL 5

Sensitometric results
of prints on paper base image-receiving materials
Processing temperature 20° C. - $CO_2$-exposure: 42 h.

| Processing solution | $D_{max}$ R | rel. log E | gamma | stain rating number |
|---|---|---|---|---|
| A | 1.92 | 0.59 | 25.2 | 1 |
| B | 1.88 | 0.57 | 23.2 | 1 |
| C | 1.82 | 0.51 | 12.4 | 2 |
| D | 1.78 | 0.57 | 14.6 | 1 |
| E | 1.95 | 0.52 | 14.3 | 1 |
| F | 1.84 | 0.59 | 10.8 | 2 |

TABEL 6

Sensitometric results
of prints on paper base image-receiving materials
Processing temperature 30° C. - $CO_2$-exposure: 42 h.

| Processing solution | $D_{max}$ R | rel. log E | gamma | stain rating number |
|---|---|---|---|---|
| A | 1.77 | 0.63 | 37.8 | 1 |
| B | 1.79 | 0.62 | 37.6 | 1 |
| C | 1.71 | 0.55 | 14.7 | 2 |
| D | 1.88 | 0.57 | 24.8 | 1 |
| E | 1.83 | 0.59 | 28.6 | 1 |
| F | 1.73 | 0.55 | 16.0 | 1 |

TABEL 7

Sensitometric results of prints on film base image-receiving materials Processing temperature 10° C. - $CO_2$-exposure: 0 h.

| Processing solution | $D_{max}$ T | rel. log E | gamma |
|---|---|---|---|
| A | 3.87 | 0.57 | 16.3 |
| B | 3.74 | 0.56 | 15.9 |
| C | 3.70 | 0.54 | 15.3 |
| D | 3.76 | 0.56 | 16.1 |
| E | 3.90 | 0.57 | 17.6 |
| F | 3.57 | 0.56 | 16.4 |

TABEL 8

Sensitometric results of prints on film base image-receiving materials Processing temperature 20° C. - $CO_2$-exposure: 0 h.

| Processing solution | $D_{max}$ T | rel. log E | gamma |
|---|---|---|---|
| A | 4.00 | 0.58 | 18.8 |
| B | 3.60 | 0.57 | 19.3 |
| C | 4.17 | 0.57 | 19.7 |
| D | 4.03 | 0.62 | 19.8 |
| E | 3.96 | 0.60 | 20.0 |
| F | 4.11 | 0.60 | 20.1 |

TABEL 9

Sensitometric results of prints on film base image-receiving materials Processing temperature 30° C. - $CO_2$-exposure: 0 h.

| Processing solution | $D_{max}$ T | rel. log E | gamma |
|---|---|---|---|
| A | 3.74 | 0.67 | 19.4 |
| B | 3.95 | 0.66 | 20.2 |
| C | 3.76 | 0.67 | 21.8 |
| D | 3.72 | 0.68 | 18.8 |
| E | 3.75 | 0.67 | 20.3 |
| F | 3.84 | 0.68 | 20.4 |

TABEL 10

Sensitometric results of prints on film base image-receiving materials Processing temperature 10° C. - $CO_2$-exposure: 42 h.

| Processing solution | $D_{max}$ T | rel. log E | gamma |
|---|---|---|---|
| A | 3.36 | 0.53 | 15.1 |
| B | 3.43 | 0.53 | 15.6 |
| C | 2.31 | 0.44 | 9.0 |
| D | 2.68 | 0.53 | 12.7 |
| E | 3.05 | 0.51 | 12.9 |
| F | 2.50 | 0.45 | 9.0 |

TABEL 11

Sensitometric results of prints on film base image-receiving materials Processing temperature 20° C. - $CO_2$-exposure: 42 h.

| Processing solution | $D_{max}$ T | rel. log E | gamma |
|---|---|---|---|
| A | 3.55 | 0.59 | 18.5 |
| B | 3.65 | 0.57 | 18.4 |
| C | 3.04 | 0.54 | 13.3 |
| D | 3.10 | 0.56 | 16.6 |
| E | 3.50 | 0.54 | 15.9 |
| F | 3.15 | 0.52 | 12.8 |

TABEL 12

Sensitometric results of prints on film base image-receiving materials Processing temperature 30° C. - $CO_2$-exposure: 42 h.

| Processing solution | $D_{max}$ T | rel. log E | gamma |
|---|---|---|---|
| A | 3.65 | 0.62 | 18.7 |
| B | 3.67 | 0.61 | 18.9 |
| C | 3.55 | 0.55 | 15.1 |
| D | 3.66 | 0.57 | 17.2 |
| E | 3.70 | 0.59 | 18.2 |
| F | 3.52 | 0.55 | 16.3 |

EXAMPLE 3

Comparative example

Example 2 was repeated with the difference however, that the following activator processing solutions were used.

Composition of activator processing solutions

| Ingredient | A | B | C | D | E | F |
|---|---|---|---|---|---|---|
| I (g) | 0.6 | id | id | id | id | id |
| II (g) | 1.0 | id | id | id | id | id |
| III (g) | 2.0 | id | id | id | id | id |
| IV (g) | 75.0 | id | id | id | id | id |
| V (g) | 14.0 | id | id | id | id | id |
| VI (g) | 0.5 | id | id | id | id | id |
| VII (g) | 0.100 | id | id | id | id | id |
| VIII (g) | 0.020 | id | id | id | id | id |
| DEEA (ml) | 80.0 | 0 | 0 | 66.5 | 0 | 0 |
| DMEA (ml) | 0 | 60.0 | 0 | 0 | 50.0 | 0 |
| DEA (ml) | 0 | 0 | 57.5 | 0 | 0 | 48 |
| MMEA (ml) | 0 | 0 | 0 | 8.0 | 8.0 | 8.0 |
| Water up to 1 l | id | id | id | id | id | id |

I: Copolymer of ethylene oxide and propylene oxide (wetting agent)
II: Hydroxyethylcellulose
III: Ethylenediaminetetraacetic acid tetrasodium salt
IV: $NA_2SO_3$ (anhydrous), [75 g of $NA_2SO_3$ contains 47.61 g of $SO_3^{--}$].
V: $NA_2S_2O_3$ (anhydrous)
VI: KBr
VII: 1-Phenyl-5-mercapto-tetrazole
VIII: 1-(3,4-dichlorophenyl)-2-tetrazolin-5-thione The obtained test wedge prints in the image-receiving materials were evaluated with regard to maximum density ($D_{max}$), yellow stain of image background and gradation (gamma-value) (see Tables A to L).

TABEL A

Sensitometric results of prints on paper base image-receiving materials Processing temperature 10° C. - $CO_2$-exposure: 0 h.

| Processing solution | $D_{max}$ R | rel. log E | gamma | stain rating number |
|---|---|---|---|---|
| A | 1.69 | 0.65 | 20.8 | 1 |
| B | 1.71 | 0.53 | 21.1 | 1 |
| C | 1.61 | 0.51 | 13.5 | 1 |
| D | 1.71 | 0.55 | 26.3 | 1 |
| E | 1.72 | 0.55 | 21.8 | 1 |
| F | 1.61 | 0.53 | 16.4 | 1 |

TABEL B

Sensitometric results of prints on paper base image-receiving materials Processing temperature 20° C. - $CO_2$-exposure: 0 h.

| Processing solution | $D_{max}$ R | rel. log E | gamma | stain rating number |
|---|---|---|---|---|
| A | 1.67 | 0.60 | 26.8 | 1 |
| B | 1.66 | 0.61 | 33.6 | 1 |
| C | 1.57 | 0.60 | 22.8 | 1 |
| D | 1.69 | 0.64 | 34.6 | 1 |

TABEL B-continued

Sensitometric results of prints on paper base image-receiving materials Processing temperature 20° C. - $CO_2$-exposure: 0 h.

| Processing solution | $D_{max}$ R | rel. log E | gamma | stain rating number |
|---|---|---|---|---|
| E | 1.66 | 0.62 | 33.5 | 1 |
| F | 1.56 | 0.63 | 27.9 | 1 |

TABEL C

Sensitometric results of prints on paper base image-receiving materials Processing temperature 30° C. - $CO_2$-exposure: 0 h.

| Processing solution | $D_{max}$ R | rel. log E | gamma | stain rating number |
|---|---|---|---|---|
| A | 1.59 | 0.67 | 30.0 | 1 |
| B | 1.61 | 0.65 | 35.9 | 1 |
| C | 1.54 | 0.64 | 29.3 | 1 |
| D | 1.67 | 0.68 | 30.3 | 1 |
| E | 1.63 | 0.66 | 35.0 | 1 |
| F | 1.55 | 0.67 | 30.6 | 1 |

TABEL D

Sensitometric results of prints on paper base image-receiving materials Processing temperature 10° C. - $CO_2$-exposure: 42 h.

| Processing solution | $D_{max}$ R | rel. log E | gamma | stain rating number |
|---|---|---|---|---|
| A | 1.76 | 0.53 | 18.9 | 1 |
| B | 1.76 | 0.52 | 17.1 | 1 |
| C | 1.76 | 0.35 | 5.0 | 6 |
| D | 1.85 | 0.49 | 11.2 | 1 |
| E | 1.85 | 0.51 | 12.5 | 1 |
| F | 1.79 | 0.35 | 4.9 | 6 |

TABEL E

Sensitometric results of prints on paper base image-receiving materials Processing temperature 20° C. - $CO_2$-exposure: 42 h.

| Processing solution | $D_{max}$ R | rel. log E | gamma | stain rating number |
|---|---|---|---|---|
| A | 1.72 | 0.59 | 26.1 | 1 |
| B | 1.68 | 0.57 | 27.1 | 1 |
| C | 1.70 | 0.48 | 11.3 | 1 |
| D | 1.83 | 0.53 | 14.6 | 1 |
| E | 1.80 | 0.54 | 17.4 | 1 |
| F | 1.70 | 0.48 | 10.8 | 1 |

TABEL F

Sensitometric results of prints on paper base image-receiving materials Processing temperature 30° C. - $CO_2$-exposure: 42 h.

| Processing solution | $D_{max}$ R | rel. log E | gamma | stain rating number |
|---|---|---|---|---|
| A | 1.67 | 0.63 | 33.5 | 1 |
| B | 1.69 | 0.62 | 34.2 | 1 |
| C | 1.68 | 0.57 | 19.5 | 1 |
| D | 1.80 | 0.60 | 27.8 | 1 |
| E | 1.69 | 0.58 | 21.5 | 1 |
| F | 1.75 | 0.61 | 30.1 | 2 |

TABEL G

Sensitometric results of prints on film base image-receiving materials Processing temperature 10° C. - $CO_2$-exposure: 0 h.

| Processing solution | $D_{max}$ T | rel. log E | gamma |
|---|---|---|---|
| A | 4.02 | 0.55 | 15.3 |
| B | 4.09 | 0.54 | 15.4 |

TABEL G-continued

Sensitometric results of prints on film base image-receiving materials Processing temperature 10° C. - $CO_2$-exposure: 0 h.

| Processing solution | $D_{max}$ T | rel. log E | gamma |
|---|---|---|---|
| C | 4.17 | 0.52 | 15.6 |
| D | 4.14 | 0.56 | 16.5 |
| E | 4.12 | 0.55 | 16.3 |
| F | 4.22 | 0.52 | 15.9 |

TABEL H

Sensitometric results of prints on film base image-receiving materials Processing temperature 20° C. - $CO_2$-exposure: 0 h.

| Processing solution | $D_{max}$ T | rel. log E | gamma |
|---|---|---|---|
| A | 3.96 | 0.62 | 16.6 |
| B | 4.13 | 0.61 | 18.6 |
| C | 4.25 | 0.60 | 19.4 |
| D | 3.93 | 0.63 | 18.4 |
| E | 4.03 | 0.62 | 19.0 |
| F | 4.13 | 0.63 | 19.2 |

TABEL I

Sensitometric results of prints on film base image-receiving materials Processing temperature 30° C. - $CO_2$ exposure: 0 h.

| Processing solution | $D_{max}$ T | rel. log E | gamma |
|---|---|---|---|
| A | 3.64 | 0.67 | 17.5 |
| B | 3.82 | 0.66 | 18.3 |
| C | 3.64 | 0.66 | 18.5 |
| D | 3.45 | 0.67 | 18.1 |
| E | 3.67 | 0.67 | 18.9 |
| F | 3.82 | 0.67 | 19.2 |

TABEL J

Sensitometric results of prints on film base image-receiving materials Processing temperature 10° C. - $CO_2$ exposure: 42 h.

| Processing solution | $D_{max}$ T | rel. log E | gamma |
|---|---|---|---|
| A | 3.86 | 0.54 | 14.4 |
| B | 3.71 | 0.53 | 14.2 |
| C | 2.70 | 0.34 | 6.8 |
| D | 2.87 | 0.52 | 11.0 |
| E | 3.12 | 0.52 | 11.9 |
| F | 2.50 | 0.35 | 6.5 |

TABEL K

Sensitometric results of prints on film base image-receiving materials Processing temperature 20° C. - $CO_2$-exposure: 42 h.

| Processing solution | $D_{max}$ T | rel. log E | gamma |
|---|---|---|---|
| A | 3.89 | 0.59 | 17.3 |
| B | 3.85 | 0.57 | 15.2 |
| C | 3.36 | 0.49 | 12.2 |
| D | 3.26 | 0.53 | 15.4 |
| E | 3.68 | 0.55 | 16.2 |
| F | 3.32 | 0.49 | 11.2 |

TABEL L

Sensitometric results
of prints on film base image-receiving materials
Processing temperature 30° C. - $CO_2$-exposure: 42 h.

| Processing solution | $D_{max}$ T | rel. log E | gamma |
|---|---|---|---|
| A | 3.48 | 0.64 | 17.7 |
| B | 3.95 | 0.62 | 16.6 |
| C | 3.44 | 0.58 | 15.5 |
| D | 3.49 | 0.61 | 18.1 |
| E | 3.41 | 0.59 | 16.4 |
| F | 3.79 | 0.63 | 17.8 |

EXAMPLE 4

Comparative example

Composition of activator processing solutions

| Ingredients | A | B | C | D | E | F |
|---|---|---|---|---|---|---|
| I (g) | 0.6 | id | id | id | id | id |
| II (g) | 1.0 | id | id | id | id | id |
| III (g) | 2.0 | id | id | id | id | id |
| IV (g) | 45.0 | 45 | 45 | 75 | 75 | 75 |
| V (g) | 14.0 | id | id | id | id | id |
| VI (g) | 0.5 | id | id | id | id | id |
| VII (g) | 0.100 | id | id | id | id | id |
| VIII (g) | 0.020 | id | id | id | id | id |
| DEEA (ml) | 80.0 | 0 | 0 | 80 | 0 | 0 |
| DMEA (ml) | 0 | 60.0 | 0 | 0 | 60 | 0 |
| DEA (ml) | 0 | 0 | 57.5 | 0 | 0 | 57.5 |
| Water up to 1 l | id | id | id | id | id | id |

I: Polymeric wetting compound
II: Hydroxyethylcellulose
III: Ethylenediaminetetraacetic acid tetrasodium salt
IV: $Na_2SO_3$ (anhydrous)
V: $NA_2S_2O_3$ (anhydrous)
VI: KBr
VII: 1-phenyl-5-mercapto-tetrazole
VIII: 1-(3,4-dichlorophenyl)-2-tetrazoline-5-thione

Results after evaporation to 650–700 ml volume of processing solution

A 1
Sensitometric results
of prints on paper base image-receiving materials
Processing temperature 10° C. - $CO_2$-exposure 0 h

| Processing number solution | $D_{max}$ R | rel. log E | gamma | stain rating |
|---|---|---|---|---|
| A | 1.80 | 0.51 | 25.9 | 1 |
| B | 1.69 | 0.49 | 28.6 | 1 |
| C | 1.66 | 0.39 | 11.1 | 1 |
| D | 1.66 | 0.39 | 11.1 | 1 |
| E | 1.67 | 0.38 | 12.2 | 1 |
| F | 1.33 | 0.32 | 2.9 | 6 |

A 2
Sensitometric results
of prints on paper base image-receiving materials
Processing temperature 20° C. - $CO_2$-exposure 0 h

| Processing number solution | $D_{max}$ R | rel. log E | gamma | stain rating |
|---|---|---|---|---|
| A | 1.71 | 0.54 | 17.3 | 1 |
| B | 1.74 | 0.55 | 29.4 | 1 |
| C | 1.63 | 0.51 | 17.4 | 1 |
| D | 1.59 | 0.56 | 21.4 | 1 |
| E | 1.64 | 0.54 | 22.3 | 1 |
| F | 1.67 | 0.43 | 10.3 | 1 |

A 3
Sensitometric results
of prints on paper base image-receiving materials
Processing temperature 30° C. - $CO_2$-exposure 0 h

| Processing number solution | $D_{max}$ R | rel. log E | gamma | stain rating |
|---|---|---|---|---|
| A | 1.62 | 0.62 | 26.0 | 1 |
| B | 1.55 | 0.59 | 26.5 | 1 |
| C | 1.62 | 0.59 | 22.8 | 1 |
| D | 1.54 | 0.63 | 22.6 | 1 |
| E | 1.56 | 0.63 | 26.2 | 1 |
| F | 1.59 | 0.56 | 16.3 | 1 |

B 1
Sensitometric results
of prints on paper base image-receiving materials
Processing temperature 10° C. - $CO_2$-exposure 42 h

| Processing number solution | $D_{max}$ R | rel. log E | gamma | stain rating |
|---|---|---|---|---|
| A | 1.76 | 0.49 | 24.6 | 1 |
| B | 1.77 | 0.49 | 18.6 | 1 |
| C | 1.74 | 0.31 | 5.1 | 6 |
| D | 1.67 | 0.45 | 10.5 | 1 |
| E | 1.69 | 0.43 | 11.3 | 1 |
| F | 1.40 | 0.35 | 2.6 | 6 |

B 2
Sensitometric results
of prints on paper base image-receiving materials
Processing temperature 20° C. - $CO_2$-exposure 42 h

| Processing number solution | $D_{max}$ R | rel. log E | gamma | stain rating |
|---|---|---|---|---|
| A | 1.75 | 0.53 | 22.1 | 1 |
| B | 1.79 | 0.54 | 30.5 | 1 |
| C | 1.75 | 0.57 | 12.7 | 1 |
| D | 1.64 | 0.53 | 13.3 | 1 |
| E | 1.66 | 0.53 | 21.2 | 1 |
| F | 1.67 | 0.40 | 8.6 | 6 |

B 3
Sensitometric results
of prints on paper base image-receiving materials
Processing temperature 30° C. - $CO_2$-exposure 42 h

| Processing number solution | $D_{max}$ R | rel. log E | gamma | stain rating |
|---|---|---|---|---|
| A | 1.70 | 0.58 | 22.4 | 1 |
| B | 1.76 | 0.61 | 32.7 | 1 |
| C | 1.71 | 0.52 | 16.6 | 1 |
| D | 1.55 | 0.58 | 16.0 | 1 |
| E | 1.58 | 0.58 | 24.4 | 1 |
| F | 1.64 | 0.48 | 13.3 | 1 |

A 4
Sensitometric results
of prints on film base image-receiving materials
Processing temperature 10° C. - $CO_2$-exposure 0 h

| Processing solution | $D_{max}$ R | rel. log E | gamma |
|---|---|---|---|
| A | 3.44 | 0.53 | 12.4 |
| B | 3.64 | 0.51 | 12.7 |
| C | 3.16 | 0.42 | 10.9 |
| D | 2.45 | 0.48 | 8.3 |

-continued

A 4
Sensitometric results
of prints on film base image-receiving materials
Processing temperature 10° C. - $CO_2$-exposure 0 h

| Processing solution | $D_{max}$ R | rel. log E | gamma |
|---|---|---|---|
| E | 2.50 | 0.42 | 7.8 |
| F | 1.51 | 0.36 | 3.9 |

A 5
Sensitometric results
of prints on film base image-receiving materials
Processing temperature 20° C. - $CO_2$-exposure 0 h

| Processing solution | $D_{max}$ R | rel. log E | gamma |
|---|---|---|---|
| A | 3.52 | 0.55 | 14.1 |
| B | 3.45 | 0.55 | 14.6 |
| C | 3.61 | 0.55 | 14.8 |
| D | 3.25 | 0.57 | 12.8 |
| E | 3.52 | 0.56 | 13.6 |
| F | 2.45 | 0.46 | 9.3 |

A 6
Sensitometric results
of prints on film base image-receiving materials
Processing temperature 30° C. - $CO_2$-exposure 0 h

| Processing solution | $D_{max}$ R | rel. log E | gamma |
|---|---|---|---|
| A | 3.42 | 0.64 | 16.9 |
| B | 3.49 | 0.61 | 16.5 |
| C | 3.62 | 0.62 | 13.3 |
| D | 3.27 | 0.63 | 16.7 |
| E | 3.34 | 0.63 | 15.1 |
| F | 3.07 | 0.57 | 15.7 |

B 4
Sensitometric results
of prints on film base image-receiving materials
Processing temperature 10° C. - $CO_2$-exposure 42 h

| Processing solution | $D_{max}$ R | rel. log E | gamma |
|---|---|---|---|
| A | 3.26 | 0.51 | 12.5 |
| B | 3.08 | 0.50 | 12.9 |
| C | 2.36 | 0.34 | 6.7 |
| D | 2.26 | 0.48 | 7.2 |
| E | 2.38 | 0.47 | 8.8 |
| F | 1.24 | 0.38 | 3.2 |

B 5
Sensitometric results
of prints on film base image-receiving materials
Processing temperature 20° C. - $CO_2$-exposure 42 h

| Processing solution | $D_{max}$ R | rel. log E | gamma |
|---|---|---|---|
| A | 3.46 | 0.53 | 14.4 |
| B | 3.67 | 0.54 | 15.6 |
| C | 3.16 | 0.48 | 12.7 |
| D | 2.86 | 0.56 | 12.0 |
| E | 3.67 | 0.55 | 13.4 |
| F | 2.26 | 0.41 | 7.8 |

B 6
Sensitometric results
of prints on film base image-receiving materials
Processing temperature 30° C. - $CO_2$-exposure 42 h

| Processing solution | $D_{max}$ R | rel. log E | gamma |
|---|---|---|---|
| A | 3.22 | 0.59 | 16.4 |
| B | 3.33 | 0.63 | 20.0 |
| C | 3.38 | 0.55 | 15.0 |
| D | 3.02 | 0.57 | 14.4 |
| E | 3.64 | 0.61 | 17.3 |
| F | 3.52 | 0.52 | 13.2 |

Sensitometric results after 42 hours $CO_2$ absorption and after evaporation to a volume of 685 ml of processing solution.

| | $D_{max}$ R | | | $D_{max}$ T | | |
|---|---|---|---|---|---|---|
| | 10° C. | 20° C. | 30° C. | 10° C. | 20° C. | 30° C. |
| | Image-receiving material A Transfer time (TT) 15 s | | | | | |
| A | 1.45 | 1.82 | 1.80 | 1.02 | 1.37 | 1.40 |
| B | 1.64 | 2.00 | 2.01 | 1.17 | 1.47 | 1.58 |
| C | 1.20 | 1.56 | 1.77 | 0.86 | 1.10 | 1.31 |
| D | 0.98 | 1.38 | 1.53 | 0.77 | 0.98 | 1.15 |
| E | 1.18 | 1.78 | 1.83 | 0.89 | 1.31 | 1.49 |
| F | 0.76 | 1.29 | 1.59 | 0.61 | 0.92 | 1.17 |
| | Image-receiving material A Transfer time (TT) 60 s | | | | | |
| A | 1.72 | 1.76 | 1.64 | 2.54 | 2.89 | 3.33 |
| B | 1.79 | 1.82 | 1.77 | 2.75 | 3.49 | 3.55 |
| C | 1.74 | 1.74 | 1.69 | 2.14 | 2.85 | 3.24 |
| D | 1.62 | 1.55 | 1.50 | 1.68 | 1.86 | 2.44 |
| E | 1.63 | 1.60 | 1.53 | 2.11 | 2.62 | 3.33 |
| F | 1.60 | 1.64 | 1.58 | 1.40 | 2.07 | 2.65 |

Processing solutions A and B within the scope of the present invention show a better processing and temperature latitude than obtained with comparative processing solutions C, D, E and F, even after 42 h of $CO_2$-adsorption and after concentrating the processing solutions by evaporating water.

The $D_{max}$R values obtained after a very short transfer time (15 s) are high for processing with solutions A and B and remain practically the same at a long transfer time (60 s) even at 30° C.

The development rate under these conditions is high for the treatment with solutions A and B and markedly less for treatment with comparative processing solutions C, D, E and F.

We claim:

1. An aqueous alkaline processing liquid for use in a silver complex diffusion transfer reversal (DTR-) process, wherein said process is carried out by development of an information-wise exposed silver halide emulsion layer with a developing agent in the presence of a silver halide solvent to form diffusible silver complexes which diffuse into an image-receiving layer containing development nuclei, (1) wherein said liquid contains no inorganic alkaline substance (s) other than an alkali metal sulfite or alkali metal thiosulfate or contains said substance(s) in an amount lower than 0.05 mole/l, (2) wherein said liquid contains a thiosulfate compound in a concentration in the range of 0.03 to 0.13 mole/l, (3) wherein said liquid comprises one or more tertiary alkanolamines having a pKa value of more than 8.5 and containing no secondary alkanolamine in a total concentration in the range of 0.3 mole/l to 1.5 mole/l, and (4) said liquid also contains sulfite ions in a concentration of 16 g/l to 30 g/l.

2. An aqueous alkaline processing liquid according to claim 1, wherein said liquid is free from developing agents.

3. An aqueous alkaline processing liquid according to claim 1, wherein the sulphite ions are stemming from sodium and/or potassium sulphite.

4. An aqueous alkaline processing liquid according to claim 1, wherein said tertiary alkanolamines correspond to following general formula (I):

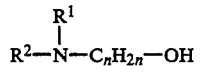

I wherein:

each of $R^1$ and $R^2$ (same or different) represents a C1–C4 alkyl group or a hydroxy substituted C2–C4 alkyl group, or $R^1$ and $R^2$ together with the nitrogen atom whereto they are linked represent the necessary atoms to form a five or six membered saturated heterocyclic ring, and n represents 1, 2, 3 or 4.

5. An aqueous alkaline processing liquid according to claim 4, wherein said tertiary alkanolamines correspond to one of the following structural formulae:

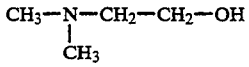

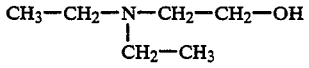

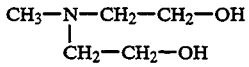

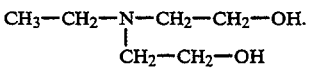

* * * * *